US005269700A

United States Patent [19]

Mitra

[11] Patent Number: 5,269,700

[45] Date of Patent: Dec. 14, 1993

[54] INSULATION DISPLACEMENT CONTACT TERMINAL

[75] Inventor: Niranjan K. Mitra, Eindhoven, Netherlands

[73] Assignee: E. I. du Pont de Nemours and Company, Wilmington, Del.

[21] Appl. No.: 875,476

[22] Filed: Apr. 29, 1992

[30] Foreign Application Priority Data

May 2, 1991 [NL] Netherlands ..... 9100761

[51] Int. Cl.[5] ..... H01R 4/24

[52] U.S. Cl. ..... 439/395; 439/402

[58] Field of Search ..... 439/389–425

[56] References Cited

U.S. PATENT DOCUMENTS

| | | | |
|---|---|---|---|
| 3,573,713 | 4/1971 | Enright et al. | 439/402 |
| 3,824,527 | 7/1974 | Evans | 339/97 |
| 3,963,319 | 6/1976 | Schumacher et al. | 339/176 |
| 4,066,320 | 1/1978 | Goodrich et al. | 439/402 |
| 4,087,150 | 5/1978 | Kubik | 339/97 |
| 4,171,857 | 10/1979 | Forberg et al. | 339/97 |
| 4,350,405 | 9/1982 | Yapoudjian et al. | 439/402 |
| 4,364,622 | 12/1982 | Huntley | 439/402 |
| 4,547,034 | 10/1985 | Forberg et al. | 339/97 |
| 5,041,006 | 8/1991 | Van Zanten et al. | 439/397 |

FOREIGN PATENT DOCUMENTS

| | | |
|---|---|---|
| 0041596 | 12/1981 | European Pat. Off. . |
| 0075150 | 9/1982 | European Pat. Off. . |
| 0109297 | 3/1983 | European Pat. Off. . |
| 0112051 | 11/1983 | European Pat. Off. . |
| 0123925 | 6/1984 | European Pat. Off. . |
| 0327330 | 9/1989 | European Pat. Off. . |
| 0427318 | 5/1991 | European Pat. Off. . |

*Primary Examiner*—Joseph H. McGlynn

[57] ABSTRACT

Insulation displacement contact (1) of electrically conducting sheet material for insulation displacement contacting of an insulated electrical conductor, comprising two sheet parts (2, 3), each sheet part (2, 3) having formed in it a slit (4, 5) with a slit opening (6, 7) which opens out in an edge of the sheet part (2, 3), in order to receive the electrical conductor. The sheet parts (2, 3) are disposed with surfaces facing each other at an angle and are each individually connected to a common base part (12) at a further edge situated opposite the slit opening (6, 7) concerned. The connection to the base part (12) here extends only over a part of the further edge. The base part (12) and the free part (16, 17) of the further edge of each sheet part (2, 3) form support points lying displaced in the direction along the surface of the sheet parts (2, 3). A connector (29) with contact elements equipped with such an insulation displacement contact (1) is also provided.

9 Claims, 2 Drawing Sheets

INSULATION DISPLACEMENT CONTACT TERMINAL

BACKGROUND OF THE INVENTION

The invention relates to an insulation displacement contact of electrically conducting sheet material, for insulation displacement contacting of an insulated electrical conductor, comprising two sheet parts, each sheet part having formed in it a slit with a slit opening which opens out in an edge of the sheet part, in order to receive the electrical conductor, and the sheet parts being disposed with surfaces facing each other and slit openings accessible from the same side.

An insulation displacement contact of this type is shown in U.S. Pat. No. 4,547,034. The two sheet parts are formed by the folded-over halves of a single sheet, while a recess extends in line with the fold line in order to facilitate folding. A similar embodiment of an insulation displacement contact is shown in U.S. Pat. No. 3,824,527, but in this case there is no recess on the fold line.

Due to the fact that these insulation displacement contacts contact a conductor at two different places, and as a result of the sheet parts being arranged with the surfaces facing each other in the form of a V, an electrically reliable and mechanically tension-resistant connection to a conductor to be contacted is obtained.

In view of the current efforts towards miniaturisation of electronic components, on the one hand, in order to produce as small equipment as possible for building in and, on the other, to accommodate as many parts as possible in equipment of given dimensions, for example in order to increase the number of functions of the equipment concerned, there is an increasing need for connectors of reduced dimensions and/or connectors with the highest possible number of contact elements without their dimensions being inadmissibly increased. As the length of connectors increases, there is in fact a risk of the printed circuit board or the substrate on which they are mounted becoming warped, the result of which is an increased risk of circuit or substrate breakages. Consequently, there is a need for insulation displacement contacts for use in such connectors.

The known insulation displacement contacts are highly unsuitable for this purpose, on account of their relatively sturdy structure in order to make them sufficiently rigid to be able to withstand bending and twisting forces during contacting of an electrical conductor. Due to the fact that the sheet parts are connected to each other at their fold line, these known contacts are also less suitable for accommodating tolerances in the positioning of the insulation displacement contact relative to the conductor to be contacted, for example a conductor of a ribbon cable.

SUMMARY OF THE INVENTION

The object of the invention is now to provide an insulation displacement contact with a design which permits further miniaturisation of connectors equipped with such contacts and, for example, a ribbon cable to be contacted.

According to the invention this is achieved in that, at a further edge situated opposite the slit opening, the sheet parts are each individually connected to a common base part, the connection to the base part extending only over a portion of the further edge, and the base part and the free portion of the further edge of each sheet part forming support points lying displaced in the direction along the surface of the sheet parts, for supporting the insulation displacement contact.

The rigidity required for being able to absorb bending and twisting forces during contacting of an electrical conductor is obtained in the insulation displacement contact according to the invention by fitting the contact in a supported manner on the supporting points formed. In this way the connection between the individual sheet parts, which is known from the state of the art and undesirably increases the dimensions of the contact, can be omitted. This in turn leads to a greater positioning freedom for the sheet parts. In addition to design benefits, with separately disposed sheet parts a flexible adjustment to tolerance deviations in the positioning of the contact itself and/or the electrical conductor to be contacted with it is possible. This self-adjusting effect is a particularly important feature of the insulation displacement contact according to the invention.

In a preferred embodiment of the insulation displacement contact according to the invention, in which the slit in a sheet part is defined by a pair of tongues, the connection to the base part extends essentially under one of the tongues of each pair of tongues. The base part in this case forms the support for one tongue of a pair of tongues, while the portion of the particular sheet part extending under the other tongue of the pair of tongues as a whole forms the other supporting point. Even with the smallest possible dimensions of the insulation displacement contact according to the invention in practice, the dimensions of this part are sufficient for supporting the contact.

In a further embodiment of the insulation displacement contact according to the invention which is advantageous as regards production, the base part is in the form of an essentially rectangular sheet, on one long edge of which the sheet parts provided with a slit are disposed, and on the opposite-lying long edge of which a contact element is connected to the base part. In addition to the above-mentioned free portion of the further edge of each sheet part, the long edge of the base part from which the contact element extends forms the other supporting point of the insulation displacement contact.

In yet another embodiment of the invention the sheet parts are connected to the base part with their surfaces slanting relative to each other and displaced over a distance. Depending on the position of the sheet parts relative to the base part, i.e. the angle which the surfaces of the sheet parts enclose, the distance between the connecting line of the slits and the central axis of the contact element can be varied. In this way an offset can be set between the central axis of the contact element and the conductor to be contacted.

An embodiment of the insulation displacement contact according to the invention which takes up relatively little space is that in which the sheet parts are connected to the base part with their surfaces parallel and with their slits aligned, and displaced over a distance. The least space is taken up in this case if the connecting line of the slits intersects the central axis of the contact element.

The insulation displacement contact can advantageously be formed in one piece from a flat metal blank.

The invention also relates to a connector, comprising a housing of electrically insulating material, in which several contact elements provided with an insulation displacement contact of the type described above are accommodated, a first and second supporting level being provided in the housing for supporting each insulation displacement contact. The insulation displacement contacts can in this case be arranged in rows or columns or staggered relative to each other. The contact elements connected to the insulation displacement contact can be in any desired form, such as a pin or socket contact.

The invention is explained in greater detail below with reference to embodiments shown in the drawing. The same or corresponding parts are indicated by the same reference number.

FIGS. *7a*, *7b* and *7c* show various arrangements of insulation displacement contacts according to the invention, viewed towards the opening for receiving an electrical conductor.

DETAILED DESCRIPTION OF THE EMBODIMENTS

Figure 1:
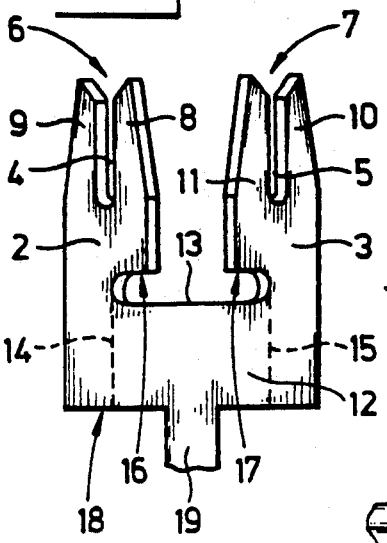
FIGS. 1 and 2 show schematically in perspective views on a different scale of the preferred embodiment of the insulation displacement contact according to the invention.

FIG. 1 shows the preferred embodiment of an insulation displacement contact 1 according to the invention, made of electrically conducting, resilient sheet material. The insulation displacement contact 1 comprises two flat sheet parts 2, 3, each provided with a slit 4, 5 having a slit opening 6,7 which opens out in an edge of the sheet parts 2, 3. The slits 4, 5 are bounded by tongues 8, 9 and 10, 11 respectively.

The flat sheet parts 2, 3 at their end lying opposite the slit opening 6, 7 are connected to an edge 13 of a base part 12 which is in the form of a rectangular sheet. The transition between the base part 12 and a sheet part 2, 3 extends here essentially under the portion of the tongues 9, 10. The dashed lines 14, 15 lying in line with the longitudinal central axis of the slit 4, 5 of a corresponding sheet part 2, 3 are fold lines about which the sheet parts 2, 3 are folded through an angle relative to the base part 12. The free portions 16, 17 of the sheet edge bounding the end of the sheet parts 2, 3 lying opposite the slit opening 6, 7, together with the long edge 18 of the base part 12, form supporting points for supporting the insulation displacement contact 1 in the fitted state. The neck 19 connected to the long edge 18 forms the transition to a contact element such as a contact socket or contact plug.

Figure 2:
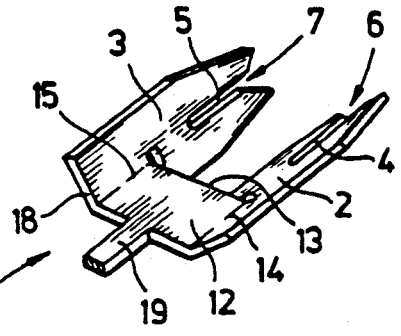

FIG. 2 shows on a smaller scale the insulation displacement contact shown in FIG. 1, viewed from another angle.

It can be seen clearly that the sheet parts 2, 3 are disposed facing each other at an angle relative to the base part 12. Instead of the slanting arrangement of the sheet parts 2, 3, they can also be disposed parallel to each other.

Fixing the sheet parts 2, 3 separately on the base part 12, displaced relative to each other over a distance, means that an insulation displacement contact of such flexibility is produced that the contacting sheet parts 2, 3 can easily accommodate tolerances in their positioning relative to a conductor to be contacted, for example a conductor of a ribbon cable.

Figure 3:
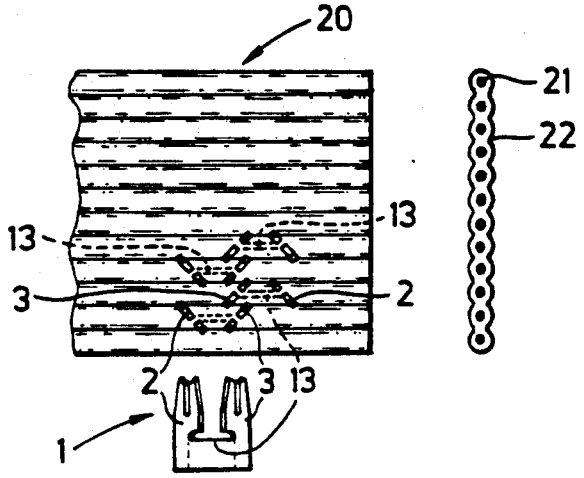
FIG. 3 shows schematically an arrangement of a number of insulation displacement contacts according to FIGS. 1 and 2 in the contacted state with insulated electrical conductors of a ribbon cable.

FIG. 3 shows schematically, in top and side view a ribbon cable 20, comprising twelve conductors 21 arranged separately from each other in a row, surrounded by a common electrically insulating sheath 22. Ribbon cables of this type are known per se. In the top view of the ribbon cable 20 shown in the lefthand part of FIG. 3 a number of the conductors 21 are shown electrically contacted by means of an insulation displacement contact according to FIG. 1, 2. For the purpose of clarification, FIG. 1 is shown on a reduced scale in FIG. 3.

The flat, unfolded part of the base part 12 with the edge 13 runs parallel to the longitudinal axis of a particular electrical conductor 21, while the two sheet parts 2, 3 are disposed obliquely, at an acute angle of 45° relative to the longitudinal axis of the conductor. It will be clear that as this angle becomes smaller the sheet parts 2, 3 can be made broader and consequently mechanically stronger. However, this is largely at the expense of the self-adjusting effect of the insulation displacement contact during the contacting of an electrical conductor. In particular, during contacting of a ribbon cable, this self-adjusting effect is an important aspect of the invention through which tolerance deviations in the contacts themselves, their mutual arrangement and tolerances of the ribbon cable can effectively be accommodated, without undesirable, faulty contacts.

The object of the shape of the sheet parts 2, 3 tapering in the direction of the slit opening 6, 7 concerned, combined with the pointed design of the tongues 8, 9, 10, 11, is to facilitate the piercing of the insulation 22 around a conductor 21. The particular shape of the sheet parts 2, 3 itself has a centring effect. Since during the plugging in of an electrical conductor 21 the torsional moment on one sheet part 2 acts in the opposite direction to the torsional moment on the other sheet part 3, the insulation displacement contact 1 shows no tendency to rotate, a risk which does exist in contacts with a single sheet part.

Figure 4A:
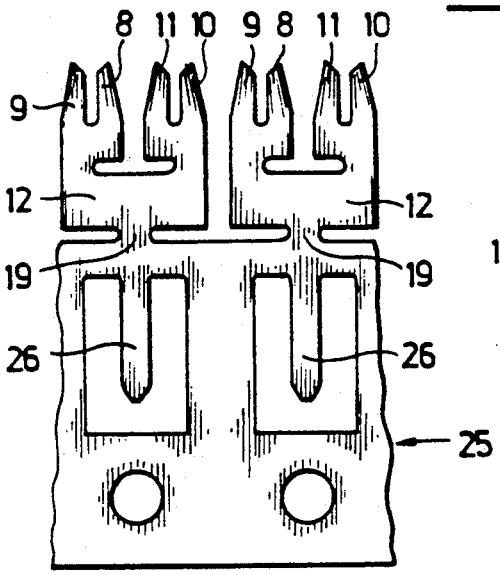
FIG. 4*a* shows a flat blank for producing the embodiment according to FIGS. 1 and 2 by folding.

FIG. 4*a* shows a part of a flat blank 25 from which the embodiment of the insulation displacement contact according to the invention shown in FIGS. 2 and 3 can be formed by folding. The flat blank 25 is itself formed from a flat sheet of metal by punching, cutting or another suitable machining technique. The neck 19 merges into a pin contact 26. Instead of a pin contact, other suitable contact elements such as a socket contact or sliding contact can, of course, also be fixed separately to the insulation displacement contact through suitable modelling of the flat blank or through soldering, welding or in another way.

Figure 4B:
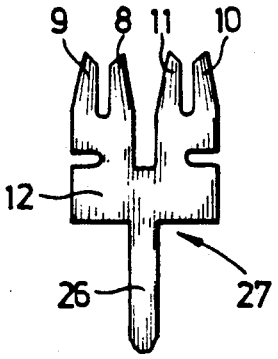
FIGS. 4*b* and 4*c* show flat blanks for producing further embodiments of the insulation displacement contact according to the invention by folding.

FIG. 4*b* shows a part of a flat blank 27 for forming the insulation displacement contact according to the invention in which, unlike the embodiment according to FIG. 4*a*, the connection to the base part 12 extends under the tongues 8, 10.

Figure 4C:
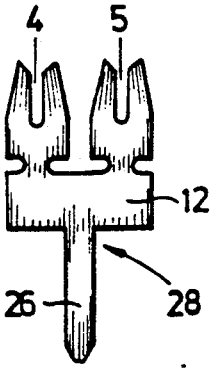

FIG. 4*c* shows a further variant of a flat blank 28 for forming an insulation displacement contact according to the invention, in which the connection to the base part 12 extends essentially under the slit 4, 5. Compared with this embodiment, the flat blanks according to FIGS. 4*a*, 4*b* have the advantage that virtually the entire width of a tongue 8, 11 and 9, 10 respectively is available for supporting the insulation displacement contact. This is particularly advantageous as the dimensions of the contact and consequently the width of the tongues decreases. Even in the case of the smallest possible dimensions in practice a portion then remains of adequate dimensions for supporting the insulation displacement contact concerned.

Figure 5:
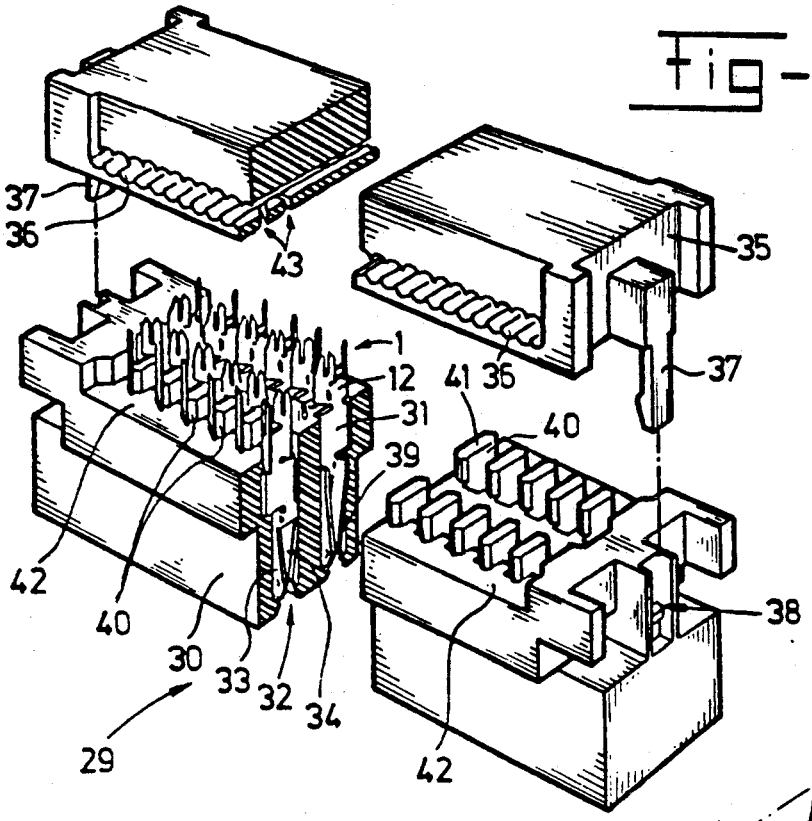
FIG. 5 shows schematically in perspective, in exploded view, a part of an embodiment of a connector in which several contact elements provided with an insulation displacement contact according to FIGS. 1 and 2 are accommodated.

FIG. 5 shows partially, in dismantled parts, a connector 29 provided with a housing 30 in which several contact elements 31 are accommodated, each provided with an insulation displacement contact 1 according to the invention, as shown in FIGS. 1 and 2. Female plugs 32 in the form of contact fingers 33, 34 are provided for contacting of a further connector. The connector also has a block 35 provided with channels 36 for accommodating one or more ribbon cables, with the proviso that only one conductor of such a ribbon cable is accommodated in each channel 36. The block 35 has laterally projecting hooks 37 which in the assembled state engage on projections 38 on either side of the housing 30, in order to achieve a locking of the block 35 and the housing 30.

The contact elements 31 are arranged in two rows displaced relative to each other, in such a way that each channel 36 in the block 35 corresponds to one insulation displacement contact 1. The housing 30 is to that end provided with transverse channels 39, which at the position of the insulation displacement contact 1 merge into elongated supporting lobes 40. The outward-facing end face 41 of these lobes 40 forms a supporting level for the edges 16, 17 of the sheet parts 2, 3 of the insulation displacement contact 1. The face 42 of the housing 30, from which the supporting lobes 40 extend outwards, forms a supporting level for the edge 18 of the base part 12 of the insulation displacement contact 1 (see FIGS. 1 and 2). For the sake of clarity, the contact elements 31 in the righthand part of the housing 30 are not shown. The channels 36 in the block 35 are provided with grooves 43, the position of which corresponds to the corresponding insulation displacement contact 1, respectively the sheet parts 2, 3 thereof. Tolerance differences between the position of a contact element 31 and the corresponding grooves 43 can easily be accommodated through the freely supported arrangement of the sheet parts 2, 3.

Figure 6:
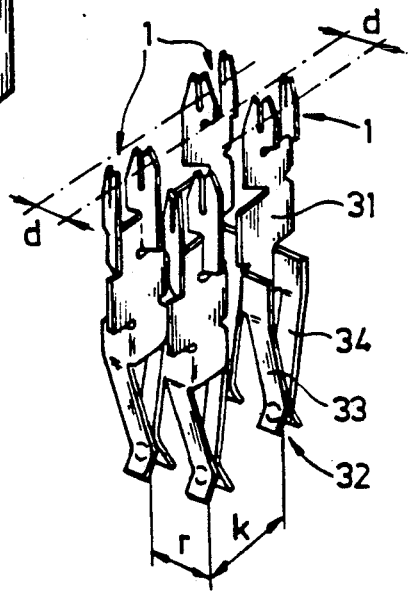
FIG. 6 shows schematically in perspective, on an enlarged scale, the contact elements provided in the connector according to FIG. 5.

FIG. 6 shows on an enlarged scale in perspective a number of the contact elements 31 used in the connector 29. By way of illustration, the distance d between the central axes of the slits of adjacent insulation displacement contacts 1 is 0.635 mm for contacting a ribbon cable with a conductor pitch of 0.635 mm. The pitch k between the adjacent female plugs 32 in a column in this embodiment is 2.54 mm, and the pitch r between the adjacent contact elements 32 in a row is 1.27 mm. The contact elements 31 are formed integrally from a flat blank of phosphor bronze 0.15 mm thick.

Figure 7A:
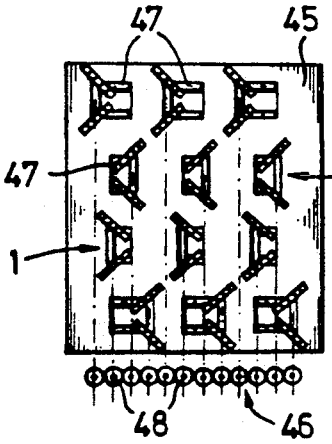

FIG. 7*a* shows schematically an arrangement of insulation displacement contacts 1 according to the invention in a housing 45, viewed from the openings for receiving the conductors to be contacted, such as a ribbon cable 46 which for purposes of illustration is shown in cross-section. This embodiment is suitable for the production of a connector with a pitch of 2 mm between the contact elements 47 connected to the insulation displacement contacts for contacting a ribbon cable 46 with a pitch of 0.5 mm between the conductors 48.

Figure 7B:
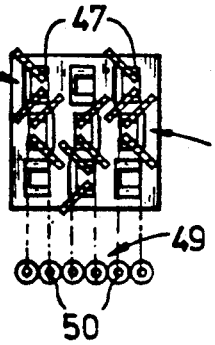

FIG. 7*b* shows a similar view to that of FIG. 7*a*, which is particularly suitable for preventing electronic capacitive and inductive coupling (cross talk) between the two outside rows of contact elements 47. By connecting the conductors 50 of the ribbon cable 49 which are contacted by the centre row of insulation displacement contacts 1 to the signal earth of a particular circuit, a mutual protection of the outside rows of contact elements is produced. A desired protective effect between the contact elements can be achieved by means of such a selective positioning of contact elements.

Figure 7C:
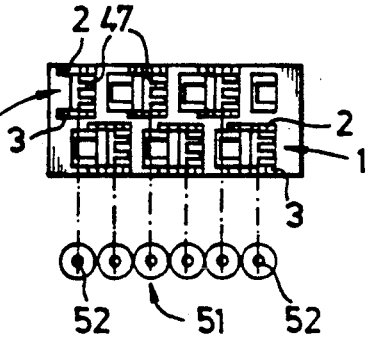

FIG. 7*c* shows a corresponding view to that of FIGS. 7*a* and 7*b*, in which the sheet parts 2, 3 of each insulation displacement contact 1 are disposed parallel to each other. This embodiment is suitable, for example, for contacting a ribbon cable 51 with a pitch of 1 mm between the conductors 52. The pitch between the contact elements 47 is 2 mm.

It will be clear from FIGS. 7*a*, 7*b* and 7*c* that the insulation displacement contact according to the invention is particularly suitable for use in connectors with low pitch, as a result of which further miniaturisation of connectors with insulation displacement contacts is possible. It must be understood that the invention is not restricted to the embodiments shown and discussed. In particular, the sheet parts 2, 3, or in this case the tongues 8, 9, 10, 11 (see FIG. 1) are suitably shaped for insulation displacement contacting of an insulated electrical conductor with relatively little force.

Instead of the top piercing shown, in which the slits 4, 5 of the insulation displacement contact extend in line with the contact part, such as the pin contact 26 in FIGS. 4*a*, 4*b* and 4*c* or the contact fingers 33, 34 in FIG. 6, the insulation displacement contact according to the invention can also be used with the same advantage in side piercing, in which case the slits 4, 5 of the insulation displacement contact extend at right angles to the contact part. In the embodiment according to FIGS. 4*b* and 4*c*, the pin contact 26 would then extend at right angles to the plane of drawing. Another example of a side piercing insulation displacement contact is shown in U.S. Pat. No. 5,041,006 assigned to the same assignee as the present application.

I claim:

1. A connector terminal for insulation displacement electrical contacting of an insulated conductor of a cable comprising:

a base member formed of electrically conducting material having an upper edge and lower edge, a pair of conductor contact portions formed integrally with said base member, each contact portion extending substantially perpendicular from said upper edge at each respective end of said base member, said upper edge of the base member extending between said contact portions, each conductor contact portion terminating at its free end in a pair of tongues having a central slit for receiving the insulated conductor, each said conductor contact portion being rotated along an axis coinciding with its central slit so that each contact portion is oriented at an angle with respect to eh remainder of the base portion, the slits of said pair of contact portions intersecting and receiving said insulated conductor at said angle, said conductor extending parallel the upper edge of said base member.

each conductor contact portion having a free support edge near the base member and opposite its free end, said free support edge extending from said base portion at said angle and being spaced from said upper edge of the base portion, each said free support edge providing a support surface for securing the terminal in a connector housing.

2. A terminal according to claim 1 wherein each conductor contact portion is integrally connected to the base member by an extension of said member disposed either under each said slit or under corresponding respective tongues.

3. A terminal according to claim 1 where said angle is 45 degrees.

4. A terminal according to claim 1 wherein said angle is 90 degrees.

5. A plurality of terminals according to claim 1 disposed is rows and columns wherein respective ones of said terminals are connected to ground to provide electrical shielding for the other terminals.

6. A terminal according to claim 1 wherein said lower edge of said base portion provides a second support surface thereby providing two support levels for maintaining said terminal in the housing.

7. A plurality of terminals according to claim 6 arranged in rows and columns in the housing of said connector, said housing having a plurality of projecting portions each of which provides a first support level for each free support edge of said terminals, said housing further having a second support surface which provides a second level of support at the lower edge of the base portion of each said terminal.

8. A plurality of terminals according to claim 1 disposed in staggered arrangement rows and columns so as to electrically contact conductors in cable which have a pitch between adjacent conductors smaller than the pitch between adjacent terminals.

9. A plurality of terminals according to claim 8 wherein the pitch between terminals is a multiple of the pitch between the conductors.

* * * * *